US005321959A

United States Patent [19]

Mitsumoto

[11] Patent Number: 5,321,959

[45] Date of Patent: Jun. 21, 1994

[54] METHOD OF KNITTING A POCKETED FABRIC WITH RIB KNIT PORTION

[75] Inventor: Shigenobu Mitsumoto, Wakayama, Japan

[73] Assignee: Shima Seiki Mfg., Ltd., Wakayama, Japan

[21] Appl. No.: 946,732

[22] Filed: Sep. 18, 1992

[30] Foreign Application Priority Data

Sep. 21, 1991 [JP] Japan ..... 3-242136

[51] Int. Cl.[5] ..... D04B 7/00

[52] U.S. Cl. ..... 66/75.1; 66/173; 66/200

[58] Field of Search ..... 66/64, 21, 171, 172 R, 66/173, 175, 176, 189, 196, 177, 200, 201, 199, 75.1, 65, 69, 72, 73

[56] References Cited

U.S. PATENT DOCUMENTS 212,580 1/1879 Wechsler ..... 66/176
1,072,640 9/1913 Nydegger ..... 66/171
1,572,434 2/1926 Kaiser ..... 66/171
3,602,914 9/1971 Castello ..... 66/172
4,038,699 8/1977 Burn ..... 66/173
4,040,275 8/1977 Castello ..... 66/64

FOREIGN PATENT DOCUMENTS 2502574 7/1975 Fed. Rep. of Germany ..... 66/171

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

Method of knitting a pocket on a knitted garment and reinforcing the upper portion of the pocket by rib knitting. Front and rear knitting needles are provided and the yarn is fed to the rear and front knitting needles as necessary and the stitches are transferred from the front needles to the rear needles and from the rear needle to the front needles as necessary for forming the pocket with the garment.

1 Claim, 7 Drawing Sheets

METHOD OF KNITTING A POCKETED FABRIC WITH RIB KNIT PORTION

BACKGROUND OF THE INVENTION

The present invention relates to a knit fabric and its knitting method in which a pocket is formed, for example, in the front body portion of knit clothes such as a sweater and cardigan integrally, the upper opening part of the pocket being reinforced by rib knitting or the like.

In order to provide a knit fabric having an integrally knitted pocket with a rib knitted portion in its upper opening part and its knitting method without sacrificing the productivity, the present applicant previously proposed those disclosed in U.S. Pat. No. 5,127,242.

In U.S. Pat. No. 5,127,242, a pocket having a rib knitted portion in its upper part is knitted at the same time as a front body portion is knitted. However, in the invention, a heat shrinkable yarn, which is supplied to the knitting needles used in knitting the front fabric at the upper end position of the pocket, needs to be heat treated after casting off from the knitting needles, and therefore, there exists a problem that it is inevitable to avoid high costs and low productivity.

SUMMARY OF THE INVENTION

The present invention provides a pocketed knit fabric with a rib knitted portion comprising a front fabric, a pocket extending from the front fabric, a pocket face portion knitted with side edges formed from a bottom of the pocket and braided into the front fabric, wherein the rib knitted portion formed continuously from the face portion in an upper portion of the pocket and the portion of knitting fabric inside the pocket facing the rib knitted portion is formed in such a way that its loops at prescribed intervals are once lapped with the side loops.

The present invention further provides a method of knitting a knit fabric having a pocket with a rib knitted portion comprising the steps of, in a flat knitting machine having multiple knitting needles positioned parallel on at least a pair of confronting needle beds in a longitudinal direction, knitting a front fabric with front knitting needles and rear knitting needles, knitting the front fabric in the pocket by the knitting needles at one side in the pocket position, and a face side of the pocket by other knitting needles, with side edges of the face side of the pocket intertwined into the front fabric, emptying, in the position of formation of the rib knitted fabric at the upper part of the pocket, the knitting needles placed at prescribed intervals among the knitting needles working on the portion of knitted fabric inside the pocket by transferring the loops held on them to the knitting needles by their side, transferring the loops of the knitting fabric in the front part of the pocket facing the empty needles concerned to said empty needles, knitting rib knitted fabric by means of the knitting needles of the fabric in the front part of the pocket and said empty needles, shifting, at the terminal end of the rib knitted fabric, the loops knitted after being transferred to said empty needles to the knitting needles in the front part of the pocket by providing protection against loosening to empty the former needles, knitting the fabric portion inside the pocket with the knitting needles found in front of the portion concerned by transferring the loops of the knitting needles of the other side working on the fabric inside the pocket to the empty needles concerned, and then knitting the front fabric with the knitting needles on one side.

DETAILED DESCRIPTION OF THE PREFERRED EMBODIMENT

Figure 1:
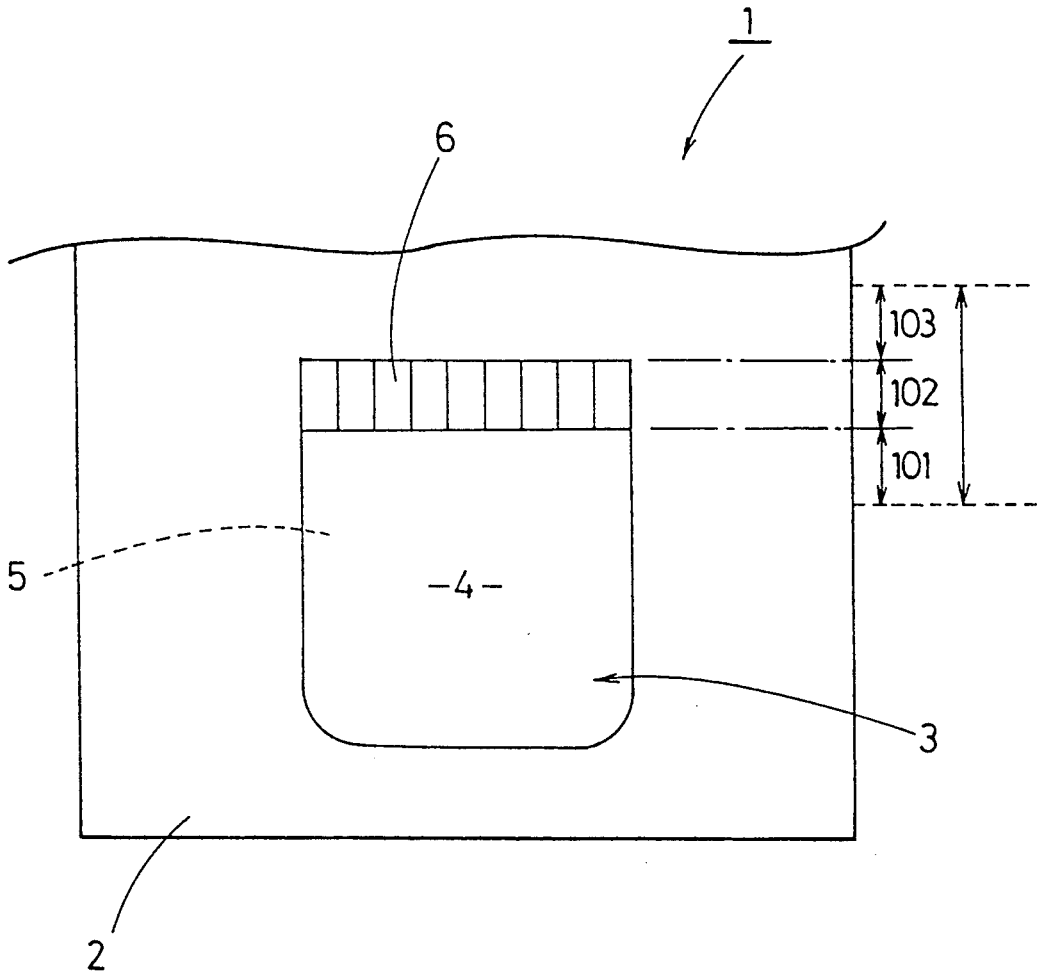
FIG. 1 is a front view of a pocketed knitted fabric having a rib knitted portion knitted with the present invention.

An embodiment of the present invention will be explained hereunder based on the drawings.

The knitting machine used in this embodiment is a flat knitting machine in which multiple knitting needles are provided slidably back and forth on the top face of needle beds (not indicated in the drawing) arranged in the shape of an overturned "V" facing each other in the side view.

FIG. 1 indicates a knitted fabric used as the front body of a sweater, etc., for example, in which a pocket having a ribbed fabric at the upper part is formed at the same time with the knitting of the fabric of the body.

This knitted fabric 1 is knitted with the front knitting needles from the bottom part of the body portion (front fabric) 2 and, at the position of forming the bottom of the pocket, as shown in the method indicated in said U.S. Pat. No. 5,127,242, the loops of the portion to form the pocket 3, which are among the loops knitting the fabric of the body portion 2, are also held on the rear knitting needles, and the front knitting needles knit the fabric on both sides of the pocket and the fabric 4 on the front part of the pocket 3 and the rear knitting needles knit the portion of fabric 5 inside tile pocket respectively. The portion before and behind the rib knitted fabric 6 are knitted by the method indicated in FIG. 2 and thereafter.

Figure 2:
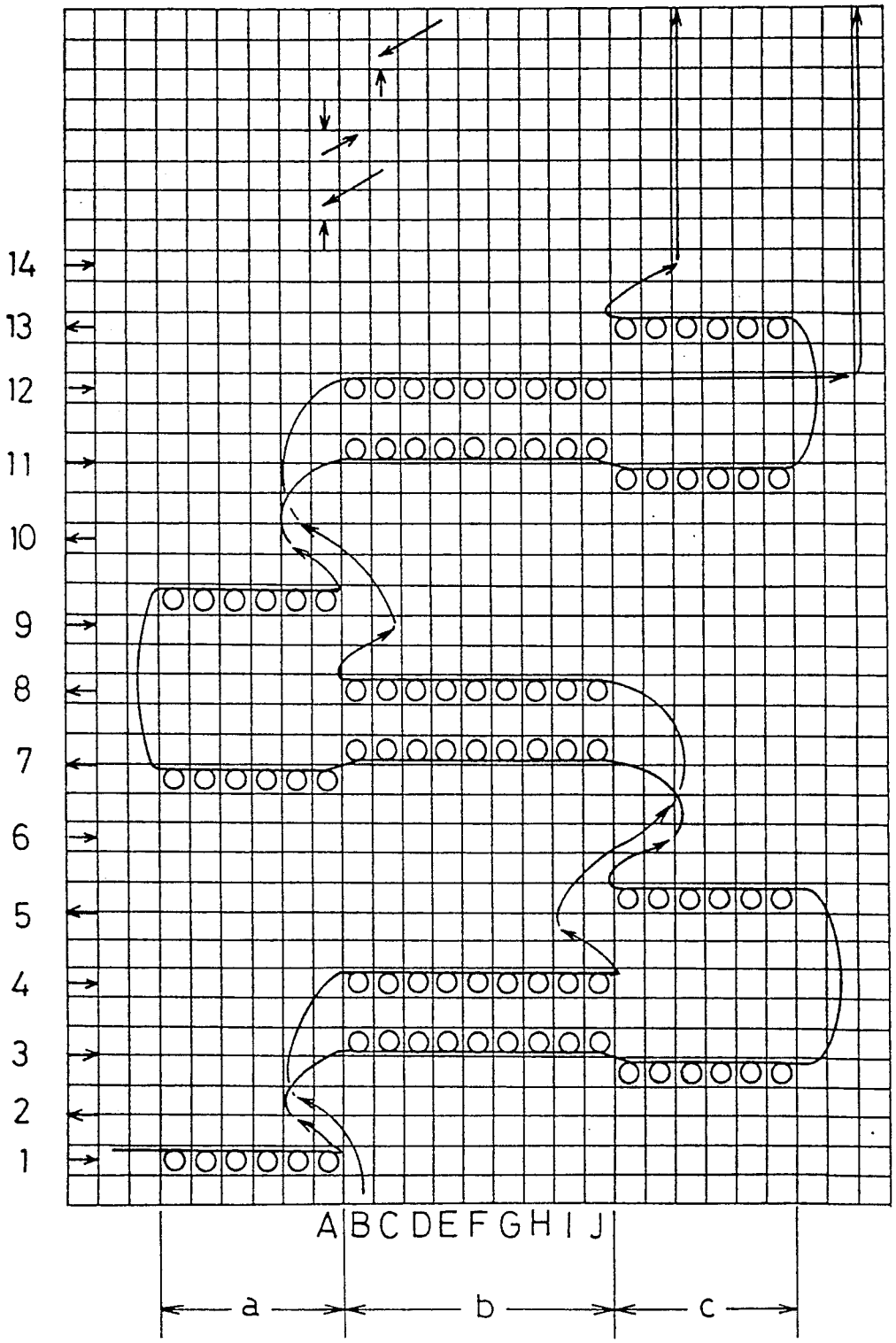
FIG. 2 is a knitting diagram of the portion 101 of FIG. 1.
Figure 3:
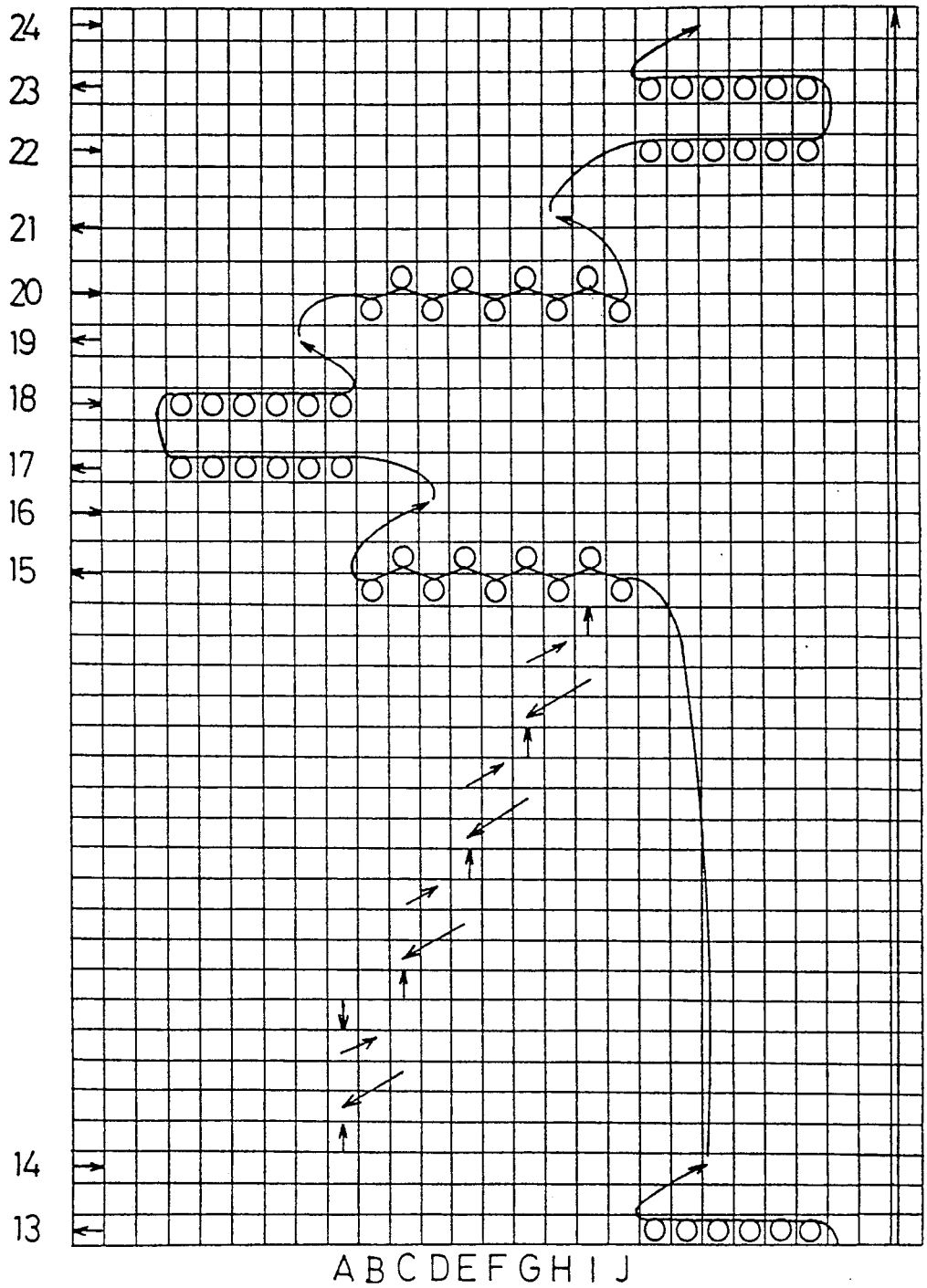
FIG. 3 is a knitting diagram of the portion 101 to the portion 102 of FIG. 1.
Figure 4:
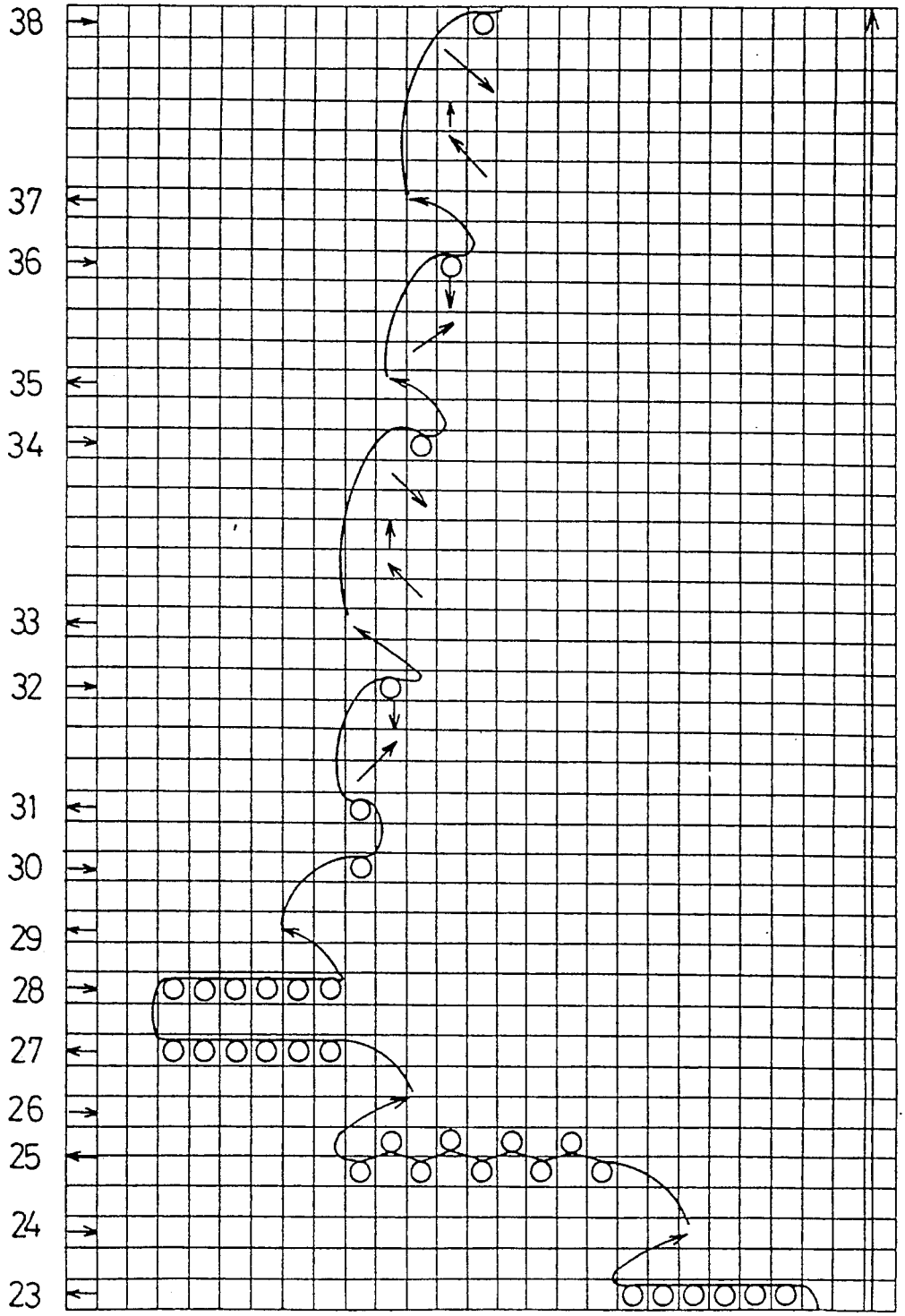
FIG. 4 is a knitting diagram of binding off in the portion 102 of FIG. 1.
Figure 5:
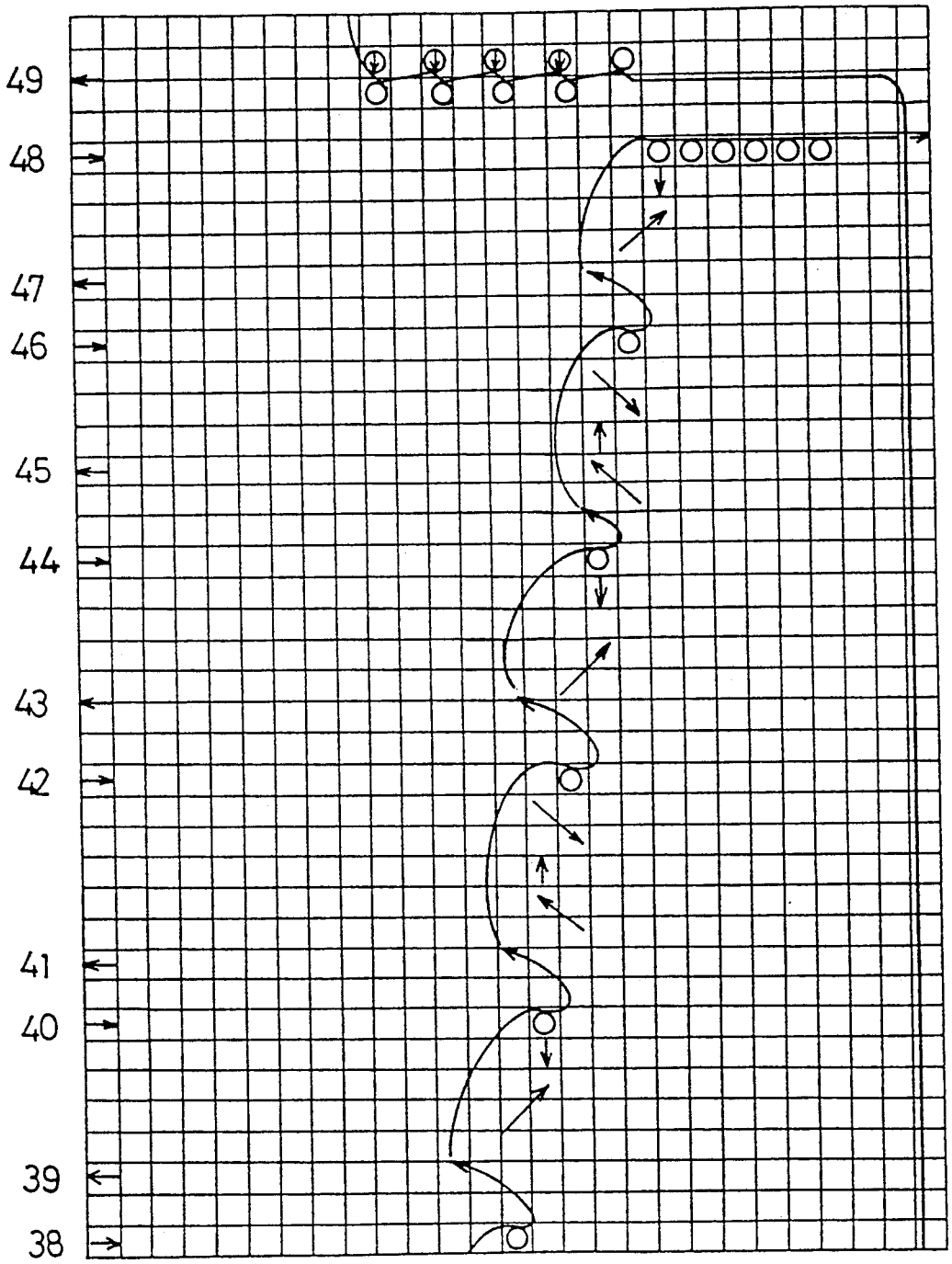
FIG. 5 is a knitting diagram of binding off in the portion 102 of FIG. 1 and split-knit made to knit the fabric inside the pocket.
Figure 6:
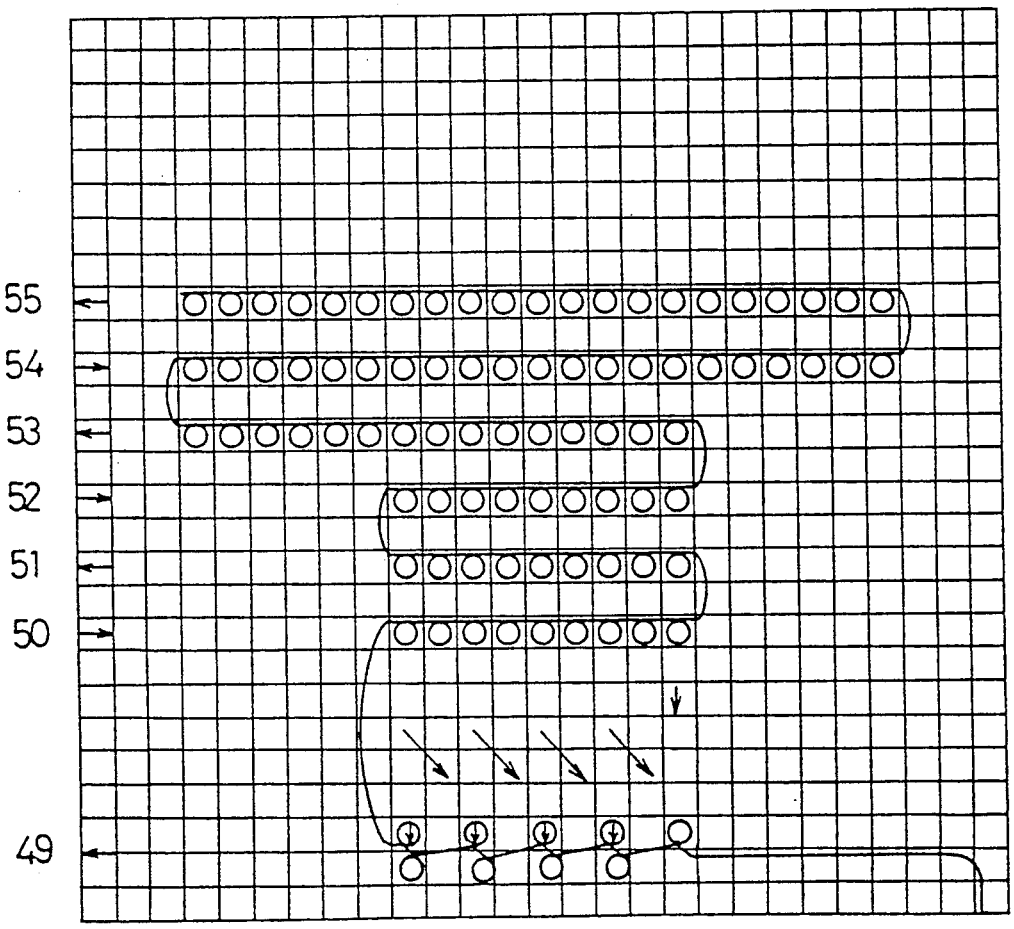
FIG. 6 is a knitting diagram of the portion 103 of FIG. 1.

Namely, FIG. 2 and FIG. 3 mainly indicate the knitting course of the portion 101 while FIG. 4 and FIG. 5 indicate the knitting course of the portion 102 and FIG. 6 indicates the knitting course of the portion 103 respectively.

The figures given in the margin on the left side of FIG. 2 to FIG. 4 are symbols indicating the knitting course where loops are formed with the yarn fed by a feeder with the movement of a carriage (neither of them is indicated in the drawing) while the arrow marks at the left end inside the frame indicate the direction of movement of the carriage.

In FIG. 2, the yarn is fed from the feeder to the front knitting needles among the knitting needles working in the body knitting area (a) on the left side of the pocket 3 to knit the body portion on the left side of the pocket 3 when the carriage moves to the right in course 1, and the feeder is shifted to outside the pocket knitting area (b) when the carriage moves to the left in course 2.

When the carriage moves to the right in course 3, the yarn is fed to the rear knitting needles in the pocket knitting area (b) and to tile front knitting needles working in the body knitting area (c) on the right side of the pocket 3, and the fabric 5 inside tile pocket is knitted by the rear knitting needles and the body portion on the right side of the pocket is knitted by the front knitting needles respectively.

In course 4, the yarn is fed from the feeder to the front knitting needles in the pocket knitting area (b) as the carriage moves to the right and, after the fabric 4 in the front part of the pocket 3 is knitted, the feeder is shifted to outside the body knitting area (c) on the right side of the pocket 3 .

After the body portion on the right side is knitted with the feeding of yarn to the front knitting needles in the body knitting area (c) in course 5, the feeder which fed the yarn to the knitting needles working on the fabric 4 in the front part of the pocket 3 and the feeder which fed the yarn to the knitting needles working on the body portion on the right side of the pocket 3 are shifted to the outside on the right of the pocket 3 in course 6.

At that time, as the feeder feeding yarn to the knitting needles working on the fabric 4 in the front part of the pocket and the feeder feeding yarn to the knitting needles working on the fabric 5 inside the pocket 3 are shifted to outside the knitting area in a crossed state as shown in course 6, the right edge of the fabric 4 in the front part of the pocket 3 is knitted in the state entwined with the border portion between the body portion on the right side of the pocket 3 and the fabric 5 inside the pocket 3.

Moreover, the left edge of the fabric 4 in the front part of the pocket 3 is knitted in the state entwined with the border portion between the body portion on the left side of the pocket 3 and the fabric 5 inside the pocket 3 when the feeders are shifted to outside the knitting area in about the same way as said right edge in courses 2 and 10.

After loops are formed on the knitting needles working the fabric 5 inside the pocket 3 and the knitting needles working on the body portion on the left side of the pocket respectively as the yarn is fed to both of them with the shifting to the left of the carriage in course 7, loops are formed on the front knitting needles working on the fabric 4 in the front part of the pocket in course 8.

After loops are formed on the knitting needles working on the body portion on the left side of the pocket 3 in course 9, the feeder is shifted to outside the pocket knitting area (b) in course 10.

After that, loops are formed on the knitting needles working on the fabric 5 inside the pocket 3 and the knitting needles working on the body portion on the right side of the pocket respectively with the yarn fed to both of them with the shifting to the right of the carriage in course 11, loops are formed on the knitting needles working on the fabric 4 in the front part of the pocket with the feeding of yarn from the feeder in course 12, and then the feeder is shifted to outside the body knitting area (c) on the right side to rest.

The fabric of the body portion on the right side of the pocket 3 is knitted with the feeding of yarn to the knitting needles working on that portion in block 13 and the feeder feeding the yarn to the knitting needles working on the body portion on the right side is shifted to outside on the right of the pocket 3 in course 14.

The shifting of the feeder to outside the knitting area is not necessarily required as it is apparent from the right side position of the fabric 4 in the front part of the pocket 3 indicated in course 15, the carriage density (cam setting the size of knitted loop) is adjusted during this shifting in this embodiment.

Thereafter, the carriage density is adjusted in the same way as above also during the shifting of the feeder to outside the knitting area performed in course 16, course 19, course 21 and course 26 to be described later.

After the feeder feeding yarn to tile knitting needles working on the body portion on the right side of the pocket 3 is shifted to the right to outside the knitting area in course 14, preparation is made for performing rib knitting in the course of the passage from course 14 to block 15 in FIG. 3.

Now, we explain this preparation for rib knitting by putting letters A–J in order from the left in the drawing to the knitting needles in the pocket knitting area (b) and a part of the body knitting area (a) adjacent to it.

When the shifting of the feeder to outside the knitting area in course 14 is over the loop held on the front knitting needle A is transferred to the rear knitting needle A first and then the loop of the rear knitting needle C is transferred to the front knitting needle A which became empty.

The loop which has been transferred to the front knitting needle A is further transferred to the rear knitting needle B and lapped with the loop existing already on the rear knitting needle B and then the loop on the rear knitting needle A is returned to the front knitting needle A. As a result, the loop which was found on the rear knitting needle C gets in the state of side shifting and this knitting needle C becomes empty.

The loop on the front knitting needle C is transferred to the rear knitting needle C which became empty to empty the front knitting needle C, and the loop on the rear knitting needle E is transferred to the front knitting needle C which became empty to empty the rear knitting needle E. After that, the loop which has been transferred to the front knitting needle C is further transferred to the rear knitting needle As a result, the loop which was found on the rear knitting needle E gets in the state of side shifting and this knitting needle E becomes empty.

Figure 7:
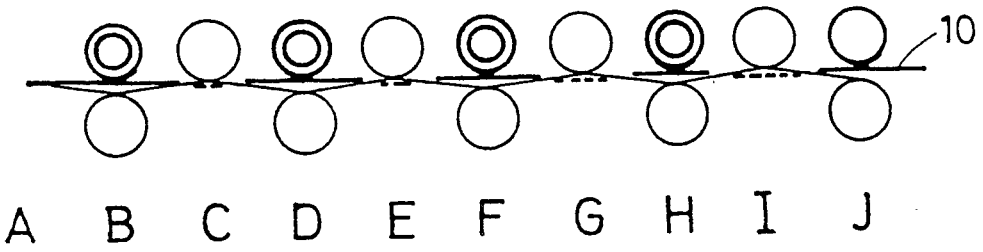
FIG. 7 is a plan view indicating the texture of the knitted fabric in the state where the preparation of the rib knitted fabric formed at the top end of the front part of the pocket is completed.

As is described in the above paragraphs, every other loop on the rear knitting needle is transferred to its next rear knitting needle, and a loop on the front knitting needle which faces the empty rear knitting needle is transferred to the empty rear knitting needle. When this operation is repeated a proper number of times, the loops of the rear knitting needles C, E, G, I which were working on the fabric 5 inside the pocket 3 are transferred and lapped on the rear knitting needles B, D, F, H as shown in FIG. 7, and the loops of the front knitting needles which were working on the fabric 4 in the front portion of the pocket 3 in block 11 get in the state of zigzag between the rear knitting needles C, E, G, I and the front knitting needles B, D, F, H above the knitting yarn 10 connecting the loops on the rear knitting needles B, D, F, H to complete the preparation for rib knitting.

The yarn is supplied to the front knitting needles B, D, F, H, J and the rear knitting needles C, G, E, I to form rib knitted fabric in course 15. After the feeder is once shifted to the right in course 16, it feeds the yarn to the knitting needles working on the body portion on the left side of the pocket 3 to form loops in block 17 and course 18 respectively.

After the feeder is once shifted to the left in course 19, it feeds the yarn to the front knitting needles B, D, F, H, J and the rear knitting needles C, E, G, I to form rib knitting fabric in course 20 and then it is once shifted to the left in block 21.

After feeding the yarn to the knitting needles working on the body portion on tile right side of the pocket 3 to form loops in course 22 and block 23, the feeder is once shifted to the right in course 24 as shown in FIG. 4.

The yarn is supplied to the front knitting needles B, D, F, H, J and the rear knitting needles C, E, G, I to form rib knitted fabric in course 25 and the feeder is shifted to the right in course 26.

Then, the yarn is fed to the knitting needles working on the body portion on the left side of the pocket 3 to form loops in block 27 and course 28 respectively and the feeder is shifted to the left in course 29. After that, this knitting of block 20 to course 29 is repeated a proper number of times and rib knitted fabric 6 of the prescribed length is formed at the upper part of the pocket 3.

Next, course 30 to block 48 given in FIG. 5 indicate the course of treating the end part of the rib knitted fabric portion 6 of prescribed length formed at the upper part of the pocket 3 as mentioned above.

Namely, after the yarn is fed to the front knitting needle B to form a loop in course 30 and block 31 and the loop is transferred and lapped on the rear knitting needle C, the loop is transferred to the front knitting needle C and then the yarn is fed to the front knitting needle C to form a loop. And the loop which was held on the front knitting needle B in course 25 is bound off while the loop on the rear knitting needle C is transferred to the front knitting needle C.

After the feeder is once shifted to the left in course 33, the loop of the front knitting needle C and the loop on the front knitting needle C is also transferred and lapped on the rear knitting needle C, and then those two loops are transferred to the front knitting needle D.

And, when the yarn is fed to the front knitting needle D and a loop is formed there in course 34, e loop which was held on the front knitting needle D in course 32 is bound off.

When the feeder is shifted to the left in course 35, the loop held on the front knitting needle D is transferred to the rear knitting needle E, the loop on the rear knitting needle E is also transferred and lapped on the front knitting need E in course 35, and then the yarn is fed to the front knitting needle E to form a loop in course 36, the loop on the front knitting needle D is bound off.

After that, in course to block 44 given in FIG. 5, the course of course 33 to course 36 is repeated and, in course 45, the feeder is once shifted to the left and then the loop on the front knitting needle J is shifted to the knitting needle I and the loop on the front knitting needle I is also transferred and lapped on the rear knitting needle I. Those two loops are then transferred to the front knitting needle J.

The yarn is fed to the front knitting needle J to form a loop in course 46 and the feeder is shifted to the left in block 47.

And, as the loop held on the front knitting needle J is once transferred to a rear knitting needle in the body knitting area (c) on the right side of the pocket adjacent to the front knitting needle J and then transferred back to the front knitting needle facing it, the loops of the knitting needles which formed the rib knitted fabric 6 at the upper part of the pocket 3 are all bound off.

After that, the yarn is fed to the front knitting needles in the body knitting area (c) on the right side to form loops in course 48 and this feeder is shifted to outside the knitting area of the fabric.

After the front portion of the pocket 3 is thus knitted, the feeder which was shifted to outside the body knitting area (c) on the right side at the end of block 12 gets in the knitting area of the fabric in course 49 indicated in FIG. 5 and FIG. 6.

In course 49, the rear knitting needles B, D, F, H holding the two loops which were suspended from knitting are made advance to the yarn feeding position and the front knitting needles B, D, F, H facing them are moved to the transfer position with a smaller advance compared with the yarn feeding position. After the yarn is fed to the rear knitting needles D, F, H and J, the knitting needles on both sides are made to retreat. As a result, loops by the knitting yarn fed are formed on the rear knitting needles B, D, F, H and J while the two loops which were so far held on the rear knitting needles B, D, F, H are transferred to the front knitting needles B, D, F, H.

After that, the loops on the rear knitting needles B, D, F, H are transferred to the front knitting needles C, E, G, I and the loop of the rear knitting needle J is transferred to the front knitting needle J. As a result, the back stitch loops which formed the fabric 5 inside the pocket 3 are transferred to the front knitting needles A to J.

And, as shown in course 50 to block 52, the fabric portion 5 inside the pocket is knitted by front stitch loops following said back stitch loops inside the pocket 3.

After the yarn is fed to the front knitting needles working on the fabric 5 inside the pocket 3 and the body portion on the left side of the pocket 3 in block 53, the course 54 and course 55 is repeated the prescribed number of times to knit the body fabric 2.

Now, the transferring made between course 14 and block 15 and the split-knit, which is defined as knitting on both front and rear beds in the same course, made in course 49 produce holes spotted on a straight line in the knitted fabric of this part but those holes do not spoil the commercial value of the knitted fabric because they are covered with the fabric in the front part of the pocket.

In the above embodiment, when the two loops held on the rear knitting needles B, D, F, H which were suspended from knitting are transferred to the front knitting needles B, D, F, H facing them, new loops made with the knitting yarn are held on the rear knitting needles and transferred to the front knitting needles to increase the number of loops in course 49. However, this is not the only method for increasing loops but it is of course possible to increase the number of loops by forming loops with a direct feed of the knitting yarn to empty needles.

Moreover, although the pocket and the respective knitted fabrics on both sides of the pocket are indicated in a narrow width and a short length for the convenience of explanation in the above embodiment, the method of the present invention is not limited to such width or length but the width and the length of the pocket and the respective knitted fabrics on both sides of the pocket can be set freely as a matter of course.

What is claimed is:

1. A method of knitting a fabric from a bottom portion of the fabric up to a bottom of a pocket by operating a flat knitting machine having a plurality of front and rear knitting needles positioned in parallel on at least a pair of confronting needle beds in a longitudinal direction of the knitting needle beds, simultaneously knitting the pocket by the front knitting needles and a portion of the fabric under the pocket by the rear knitting needles with side edges of a face side of the pocket braided into the front fabric, forming a rib knitted portion at the upper part of the pocket, said step of forming a rib knitted portion further comprising the steps of:

emptying every other rear knitting needle among the rear knitting needles working on the portion of the front fabric under the pocket by transferring loops held on said every other rear knitting needle to rear knitting needles of another side;

transferring loops of the pocket held on the front knitting needles confronting said every other rear knitting needle to said every other rear knitting needle;

knitting the rib knitted portion by supplying a thread to the front knitting needles holding loops and to said every other rear knitting needle; and binding off the loops at the terminal end of the rib knitted portion held on the front knitting needles to empty the front knitting needles, said method further comprising the steps of:

transferring the loops of the portion of the front fabric under the pocket to the front knitting needles, and knitting the portion of the front fabric under the rib knitted portion using the front knitting needles.

* * * * *